United States Patent [19]

Van Pelt

[11] Patent Number: 4,698,504

[45] Date of Patent: Oct. 6, 1987

[54] INSERTS ATTACHABLE TO A WIRE MESH BELT FOR SUPPORTING SHEETS IN A THERMOGRAPHY APPARATUS

[75] Inventor: Christopher K. Van Pelt, Nokomis, Fla.

[73] Assignee: Thermo-O-Type Corporation, Nokomis, Fla.

[21] Appl. No.: 856,401

[22] Filed: Apr. 28, 1986

[51] Int. Cl.[4] ..... G03C 5/16

[52] U.S. Cl. ..... 250/319; 118/324; 198/699.1

[58] Field of Search ..... 250/316.1, 317.1, 319; 198/699.1, 692, 693; 118/324, 500

[56] References Cited

U.S. PATENT DOCUMENTS

| | | | |
|---|---|---|---|
| 1,346,650 | 7/1920 | Hendrickson | 198/699.1 |
| 1,872,629 | 8/1932 | Fahrenwald | 198/699.1 |
| 3,055,488 | 9/1962 | Stone | 198/699.1 |
| 3,526,207 | 9/1970 | Nadelson | 198/699.1 |
| 3,561,907 | 2/1971 | Campbell | 198/699.1 |
| 3,679,050 | 7/1972 | Anderson et al. | 198/699.1 |
| 4,463,704 | 8/1984 | Farnham | 118/642 |

FOREIGN PATENT DOCUMENTS

| | | | |
|---|---|---|---|
| 0092420 | 10/1959 | Netherlands | 198/699.1 |

*Primary Examiner*—Bruce C. Anderson
*Assistant Examiner*—Paul A. Guss
*Attorney, Agent, or Firm*—Burns, Doane, Swecker & Mathis

[57] ABSTRACT

A thermography apparatus includes a wire mesh conveyor belt for conveying sheets through a heating zone in which a resin is heated and melted. A plurality of inserts is mounted on the belt for supporting the sheets. Each of the inserts comprises an elongate strip, the strip including an edge integrally formed with a plurality of pointed projections. A widest cross-section of the insert is sized to permit the insert to be inserted laterally into a lateral opening in the belt with the projections thereof lying in the plane of the belt and then rotated 90° to a position wherein the projections extend beyond the plane of the belt to support the sheets. Provided at each end of the strip is a pair of bendable tabs which can be crimped around a wire portion of the belt to anchor the strip to the belt. Since the sheets are supported only by pointed projections, thermography printing can be performed on both sides of the sheets with little risk of the ink being smeared.

14 Claims, 6 Drawing Figures

Fig. 2
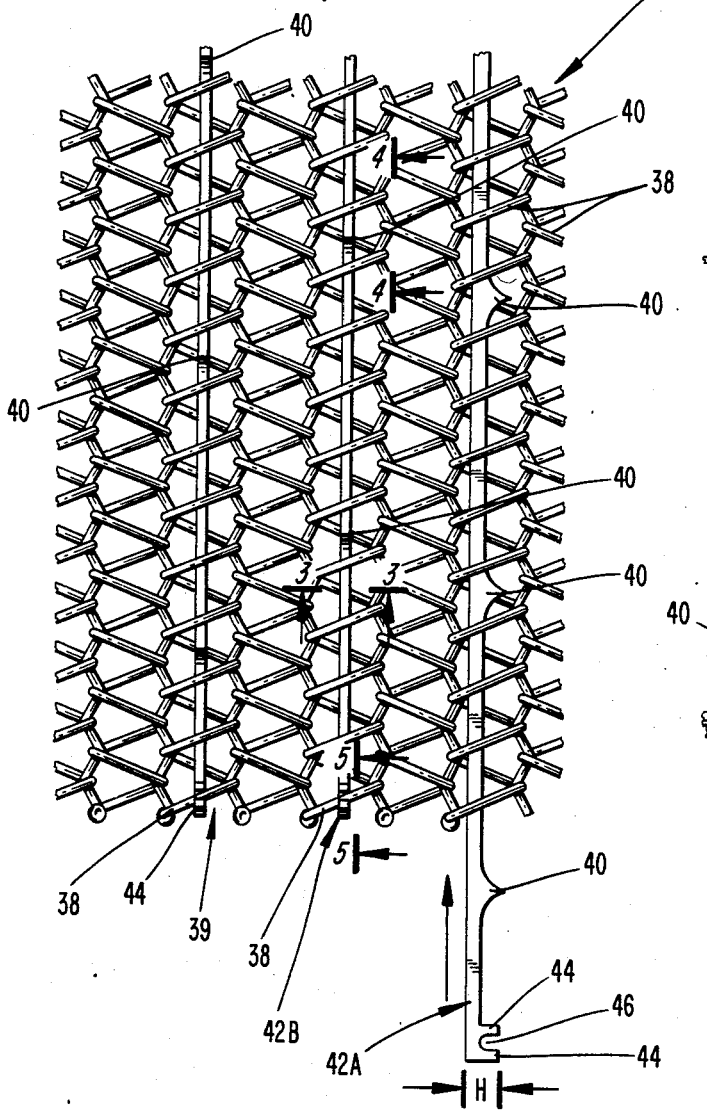
Fig. 3
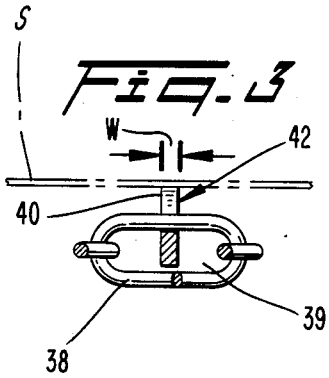
Fig. 4
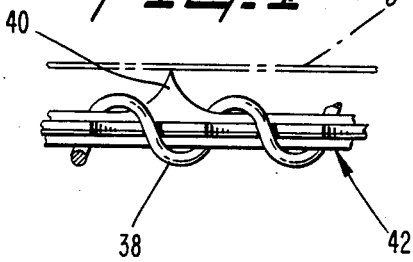
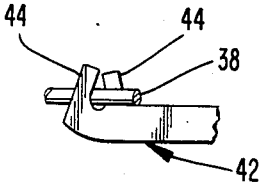
Fig. 5
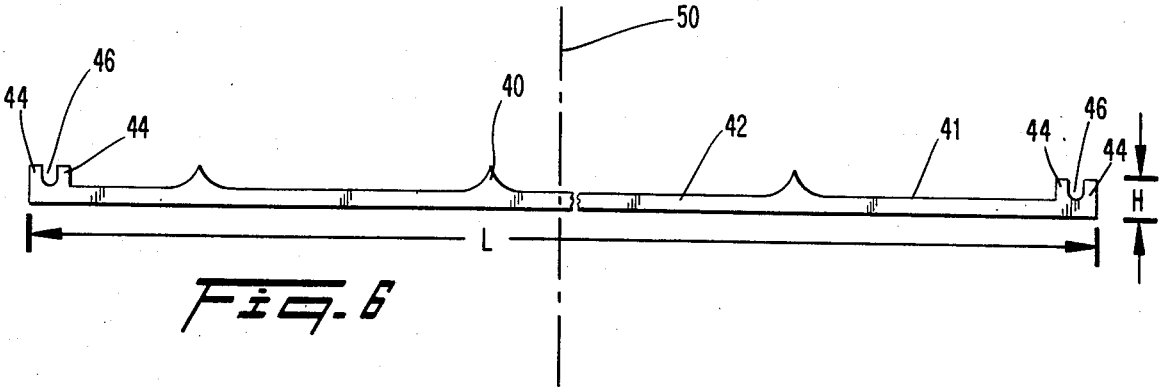
Fig. 6

INSERTS ATTACHABLE TO A WIRE MESH BELT FOR SUPPORTING SHEETS IN A THERMOGRAPHY APPARATUS

BACKGROUND OF THE INVENTION

The present invention relates to thermography apparatus and, in particular, to the conveying of sheets which are to be printed thermographically on both sides.

Thermography, or raised printing, is carried out by applying a thermography powder, such as a resin-based powder, onto a printed sheet while the ink thereon is still tacky. Sufficient heat is applied to melt the powder, whereupon the powder expands and thus imparts a "raised" effect to the printed areas.

One type of thermography apparatus which has heretofore been employed for carrying-out raised printing operations has included a powder-applying section through which the printed paper sheets are fed. In this section, resinous powder, e.g., a nylon resin, is applied from a hopper onto the printed surface of each sheet and adheres to the still-tacky ink. Thereafter, excess powder is sucked from the sheet by a vacuum pick-up head, leaving powder only on the ink. The sheets are then conveyed through a heat tunnel in which the sheets are powder are heated to the melting temperature of the powder. As the powder melts, it expands and thus "raises" the printing. Thereafter, the sheets are conveyed through a cooling tunnel wherein the raised print is solidified.

During that process, the sheet is conveyed along one or more conveyor belts through a powder-applying zone, a heating zone, and a cooling zone. The powder is applied to the top side of the sheet, while the underside thereof rests upon the conveyor belt. The conveyor belt is of a type capable of withstanding high temperatures, such as a stainless steel wire-mesh belt.

In some cases it is desirable to subject both sides of the sheet to a raised printing process. This is achieved, following the raised printing treatment of the top side of the sheet, by inverting the sheet and again passing the sheet through the thermography apparatus. As the sheet passes again through the heating zone, the resin previously applied to the side of the sheet now faces the conveyor belt and is melted in areas where it is contacted by the hot wires of the mesh belt. As a result of that contact and melting, there occurs a tendency for the resin to be smeared, thereby marring the aesthetic appearance of the product.

In an effort to alleviate that problem, it has therefore been proposed in Nadelson U.S. Pat. No. 3,526,207, to provide the conveyor belt with upstanding pointed pins upon which the sheets are supported. As a result, the areas of contact between the resin and belt are constituted by minutes points, whereby little, if any, readily detectible smearing of the resin will occur. The Nadelson patent discloses the provision of inserts which can be positioned within the conveyor belt links. The insert comprises a flat bar which can be slid into a lateral spaced formed between the wires. The bar includes a series of threaded holes which face upwardly after the bar has been inserted. The holes are adapted to receive the threaded ends of pointed pins by screwing the pins into the holes after the bar has been inserted into the belt. The pins are dimensioned to project above the belt to support the sheets.

Such a proposal involves certain technical drawbacks. For example, in order to properly modify a typical thermotype conveyor belt under the Nadelson proposal, it would be necessary to manually screw-in a larger number, perhaps hundreds, of pins, a very time-consuming process. Furthermore, since the pins will be subjected repeatedly to high and low temperature cycles, it is quite likely that the repeated thermal expansion and contraction of the pins and bars will, over a period of time, produce a loosening of the pins. Moreover, Nadelson does not appear to disclose any means for anchoring the bars against movement relative to the conveyor belt. Any such relative movement which occurs may magnify the smearing of the resin to such as extent that the smearing becomes more readily detectible.

It is, therefore, an object of the present invention to minimize or obviate shortcomings of the type discussed above.

A further object is to provide a sheet-supporting insert for a thermography conveyor belt which can be easily and rapidly installed.

A further object is to provide such an insert wherein the sheet contacting portions cannot become loosened.

An additional object is to provide such an insert which can be anchored against movement relative to the conveyor belt.

SUMMARY OF THE INVENTION

These and other objects are achieved by the present invention which involves a thermographic apparatus comprising a wire mesh conveyor belt for conveying sheets successively through a powder zone, a heating zone, and a cooling zone. In the powder zone, powdered thermographic resin is applied to printed sides of the sheets and excess resin is removed therefrom. In the heating zone, the resin is heated and melted and is thereafter subsequently cooled in the cooling zone. The wire mesh belt forms a series of lateral openings. A plurality of inserts is mounted on the belt for supporting the sheets. Each of the inserts comprises an elongate strip. The strip includes an edge integrally formed with a plurality of pointed projections. A widest cross-section of the insert is sized to permit the insert to be inserted laterally into one of the openings in the belt with the projections thereof lying in the plane of the belt and then rotated 90° to a position wherein the projections extend beyond the plane of the belt to support the sheets. The insert includes attachment elements attachable to wire portions of the belt to anchor the strip to the belt. Since the sheets are supported on points, the sheets can be thermographically printed on both sides, with little risk that appreciable smearing will occur.

Preferably, the attachment elements comprise a pair of bendable elements located at each end of the strip. Each pair of elements comprises two spaced apart tabs forming a recess therebetween sized to receive the wire portion of the belt so that the tabs can be crimped together around such wire portions.

The projections are preferably disposed non-symmetrically relative to a perpendicular bisector of the insert, so that successively located ones of the inserts can be reversed relative to one another to laterally stagger the projections.

The present invention also involves the above-described insert per se.

BRIEF DESCRIPTION OF THE DRAWINGS

The objects and advantages of the invention will become apparent from the following detailed description of a preferred embodiment thereof in connection with the accompanying drawings in which like numerals designate like elements, and in which:

FIG. 2 is a fragmentary top plan view of a wire mesh belt which can be utilized in the heating section of the thermography machine depicted in FIG. 1, there being provided a plurality of pointed inserts in the belt and one of the inserts being depicted in a condition as it is being inserted through a lateral opening of the belt;

FIG. 3 is a cross-sectional view taken along line 3—3 of FIG. 2;

FIG. 4 is a cross-sectional view taken along line 4—4 of FIG. 2;

FIG. 5 is a cross-sectional view taken along line 5—5 of FIG. 2; and

FIG. 6 is a side elevational view of an insert according to the present invention.

DETAILED DESCRIPTION OF A PREFERRED EMBODIMENT OF THE INVENTION

Figure 1:
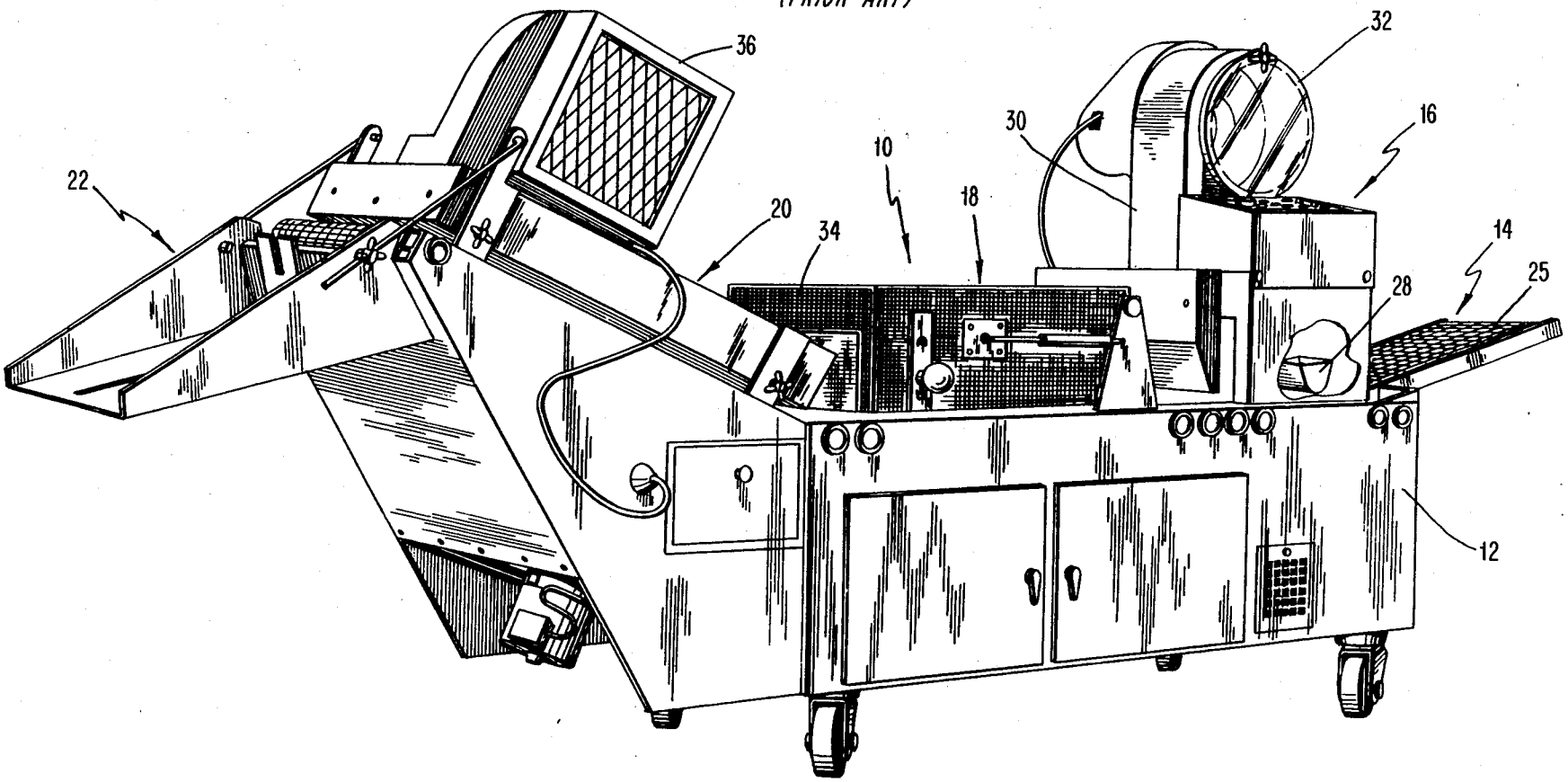
FIG. 1 (PRIOR ART)
FIG. 1 is a perspective view of a thermography machine.

A thermography machine 10 according to the present invention comprises a frame 12 which supports a sheet infeed section 14, a powder applying section 16, a heating section 18, a cooling section 20, and a discharge section 22.

The paper infeed section is conventional and includes a first driven belt 25 for feeding sheets one-at-a-time to a second driven belt (not shown), the latter feeding the sheets through the powder applying section 16. The powder applying section 16 includes a conventional hopper 28 which is situated above the second belt and applies a thermography powder, e.g., a nylon resin based powder, onto the upwardly facing ink-printed surface of each sheet. The powder is applied while the ink is still in a tacky state so that the powder adheres to the ink.

Excess powder is thereafter sucked from the sheet and belt by a conventional vacuum pick-up unit (not shown) which is situated above the second belt at a location downstream of the hopper. The powder travels from the pick-up unit to a conventional powder/air separator 32 via duct 30.

After receiving the powder, the sheets are passed onto a heat-resistant third conveyor belt 33 (FIG. 2) which conveys the sheets through a heating tunnel 34 of the heating section 18. The heater tunnel contains electric resistance heaters such as a standard Vycor glass, multi-section, infrared electric heater which heats the powder and sheets passing therebeneath. As the heated powder melts, it expands, thereby producing the "raised" effect.

After leaving the heater tunnel 34, the sheets are passed through the cooling section 20 wherein cooling air is blown by a fan 36 onto the sheets to harden the ink. Eventually, the sheets are discharged via the discharge section 22.

The conveyor belt 33 of the heating section is of the wire mesh type, preferably formed of stainless steel wire loops 38, which are interloped and form internal lateral openings or passages 39 (FIG. 3).

In cases where the raised printing effect is to be applied to both sides of a sheet, the sheet is first subjected to a raised printing treatment on one side. Next, the sheet is printed on the opposite side and subjected to a second raised printing treatment. If, during this second treatment, the initially treated side were to lie directly upon the conveyor belt during travel through the heating zone, the resin contacting the hot links of the belt could melt and become smeared to a readily visible extent.

In accordance with the present invention the sheets, rather than being supported directly upon the wire mesh, are supported thereabove upon pointed projections 40 (FIG. 6). The projections 40 comprise portions of a monolithic insert mounted within the openings 39 of the wire mesh belt. Each insert, preferably formed of stainless steel, comprises an elongate strip, with the projections 40 integrally formed along a narrowest edge 41 of the strip. The projections are spaced along a length L of the strip and project in the direction of the height H of the strip. The height is smaller than a width W of the strip.

The insert is initially inserted into a lateral opening 39 of the belt with the height H lying in the plane of the belt as depicted via insert 42A in FIG. 2. The insert is then rotated 90° to a position in which the projections 40 extend between the links and upwardly beyond the plane of the belt, as depicted via insert 42B in FIG. 2.

Each end of the insert contains at least one bendable element, e.g., a pair of tabs 44 which are spaced apart to form a recess 46 therebetween sized to receive a wire 38 of the wire mesh belt. The tabs are bendable around the wire (FIG. 5) by means of a suitable crimping tool (not shown), in order to fixedly secure the insert to the belt and prevent relative movement therebetween.

The projections 40 are positioned non-symmetrically relative to a perpendicular bisector 50 of the insert. As a result, successively arranged ones of the inserts can be mutually reversed so that the projections 40 thereof are laterally staggered relative to one another. In this way, fewer total projections are needed to provide the necessary support for the sheets.

As the sheets S are conveyed upon the projections, with previously thermographically printed sides of the sides facing the mesh belt, there will likely occur some contact between the pointed ends of the projections 40 and the resin. However, this contact will be minimal and insufficient to produce any readily discernable smearing of the resin.

It will be appreciated that in accordance with the present invention, installation of the inserts is simplified in that it is unnecessary to attach each projection individually as in the case of the earlier described insert of U.S. Pat. No. 3,526,207. Also, the projections of the present invention cannot become loosened as a result of thermal expansion and contraction since the insert, including the projections is a monolithic structure. In addition, the inserts are fixedly secured to the belt and are restrained against relative movement therebetween in a manner which could otherwise produce smearing.

Although the present invention has been described in connection with a preferred embodiment thereof, it will be appreciated by those skilled in the art that modifications, substitutions, additions and deletions not specifically described may be made without departing from the spirit and scope of the invention as defined in the appended claims.

What I claim is:

1. A thermography apparatus comprising a wire mesh conveyor belt for conveying sheets successively through a powder zone, a heating zone, and a cooling zone, said powder zone comprising means for applying powdered thermographic resin to printed sides of the sheets and means for removing excess resin from the sheets, said heating zone including means for heating and melting the resin which is subsequently cooled in said cooling zone, said wire mesh conveyor belt forming a series of lateral openings, and comprising a plurality of inserts mounted on said belt for supporting said sheets, said inserts each comprising an elongate strip, said strip including an edge integrally formed with a plurality of pointed projections spaced along a length of said strip and projecting in the direction of a height of said strip, said height being greater than a width of said strip, to permit said insert to be inserted laterally into one of said openings in said belt with said projections thereof lying in the plane of said belt and then rotated 90° to a position wherein said projections extend beyond the plane of said belt to support the sheets, said insert including attachment means attachable to wire portions of said wire mesh belt to anchor said strip to said belt.

2. Apparatus according to claim 1, wherein said attachment means comprises at least one bendable element which is bendable around said wire portion.

3. Apparatus according to claim 2, wherein a pair of said bendable elements is provided at each end of said strip, each said pair comprising two spaced apart crimpable tabs forming a recess therebetween sized to receive said wire portion of said wire mesh belt.

4. Apparatus according to claim 3, wherein said projections are disposed non-symmetrically relative to a perpendicular bisector of said insert.

5. Apparatus according to claim 1, wherein said projections are disposed non-symmetrically relative to a perpendicular bisector of said insert.

6. Apparatus according to claim 1, wherein said inserts are stainless steel.

7. Apparatus according to claim 1, wherein said edge which carries said projections constitutes a narrowest edge of said strip.

8. An insert to be inserted into lateral openings of a wire mesh belt in a thermography apparatus, said insert comprising an elongate strip, said strip including an edge integrally formed with a plurality of pointed projections spaced along a length of said strip and projecting in the direction of a height of said strip, said height being greater then a width of said strip, to permit said strip to be inserted into a lateral opening of a wire mesh belt with said projections thereof lying parallel to the plane of the belt and then rotated 90° to a position wherein said projections extend beyond the plane of the belt to support sheets, said insert including attachment means attachable to a wire portion of the belt to anchor the strip to the belt.

9. An insert according to claim 8, wherein said attachment means comprises at least one bendable elements which is bendable around said wire portion.

10. An insert according to claim 9, wherein a pair of said bendable elements is provided at each end of said strip, each said pair comprising two spaced apart crimpable tabs forming a recess therebetween sized to receive said wire portion.

11. Apparatus according to claim 10, wherein said projections are disposed non-symmetrically relative to a perpendicular bisector of said insert.

12. Apparatus according to claim 8, wherein said projections are disposed non-symmetrically relative to a perpendicular bisector of said insert.

13. Apparatus according to claim 8, wherein said insert is stainless steel.

14. Apparatus according to claim 8, wherein said edge which carries said projections constitutes a narrowest edge of said strip.

* * * * *